US006544342B1

(12) United States Patent
O'Keefe et al.

(10) Patent No.: US 6,544,342 B1
(45) Date of Patent: Apr. 8, 2003

(54) ACID BATH FOR REMOVING CONTAMINANTS FROM A METALLIC ARTICLE

(75) Inventors: William K O'Keefe, New Dundee (CA); Pierre Pinet, Lisle (CA)

(73) Assignee: Husky Injection Molding Systems, Ltd., Bolton (CA)

( * ) Notice: Subject to any disclaimer, the term of this patent is extended or adjusted under 35 U.S.C. 154(b) by 226 days.

(21) Appl. No.: 09/724,424

(22) Filed: Nov. 28, 2000

(51) Int. Cl.[7] ..... B08B 3/08

(52) U.S. Cl. ..... 134/3; 134/28; 134/41; 134/99.1; 134/100.1; 134/108

(58) Field of Search ..... 134/99.1, 100.1, 134/108, 155, 186, 3, 28, 41

(56) References Cited

U.S. PATENT DOCUMENTS 3,181,541 A * 5/1965 Brooking ..... 134/186
5,671,760 A * 9/1997 Nakagawa et al. ..... 134/56 R
5,823,210 A * 10/1998 Inada et al. ..... 134/105
5,845,660 A * 12/1998 Shindo et al. ..... 134/56 R
6,131,588 A * 10/2000 Kamikawa et al. ..... 134/108 X
6,354,310 B1 * 3/2002 Farr et al. ..... 134/56 R

* cited by examiner

*Primary Examiner*—Philip Coe
(74) *Attorney, Agent, or Firm*—Katten Muchin Zavis Rosenman

(57) ABSTRACT

A method and apparatus for removing contaminants from the surface of a metallic article comprises a continuously flowing acid bath whose level of acidity and temperature is controlled and over which a purging gas flows to continuously remove hazardous gases generated during the removal of contaminants from the metallic article.

21 Claims, 4 Drawing Sheets

Cylindrical cross section

Rectangular cross section

ACID BATH FOR REMOVING CONTAMINANTS FROM A METALLIC ARTICLE

BACKGROUND OF THE INVENTION

1. Field of the Invention

The present invention relates to the art of metal alloy injection molding and, in particular, to methods and apparatus for removing contaminants from parts used in the injection process.

2. Related Prior Art

In the typical metal alloy injection molding process an extruder screw is used to move the alloy toward a collection site and force the alloy into a mold. Occasionally it is necessary to remove the screw from the injection unit. When this is done it is difficult to ensure that some of the metal alloy does not adhere to the screw. This adhering alloy must be removed from the screw before it is put back in the injection unit. Although the common practice in removing screws is to first purge the metal alloy from the barrel, the screws that are removed typically are encased in a certain amount of alloy, particularly in the check valve region. Some of this alloy can be chipped away with a brass chisel, however a significant amount of alloy remains on the screw. In order to remove this remaining alloy, the relatively high solubility of the metal alloys typically used in injection molding, such as magnesium, aluminum or zinc based alloys, in acidic media has been exploited. For example, magnesium based alloy was removed by dissolving it in hydrochloric acid. This process involved soaking the screw in a bath of hydrochloric acid. However, in those instances where the screw is coated with a corrosion prevention coating or layer such as Stellite, the hydrochloric acid can effect the interface between the coating and the screw. A phosphoric acid solution was used in place of the hydrochloric acid. While the phosphoric acid did not interfere with the coating-screw interface, other problems still existed with the process.

As illustrated in FIG. 1, the prior art process involves placing the screw in a tubular leach vessel 1. The vessel 1 is filled with an aqueous phosphoric acid bath 2 that circulates through the leach vessel 1, passing over the screw placed in the bath 2 and exiting to an acid holding tank 3. The leach vessel 1 consists of a PVC pipe with end caps 4 to seal the vessel 1. Polypropylene tubes allow the acid to enter and exit the vessel. Under acidic conditions, an electrochemical reaction occurs at the metal alloy-acid interface resulting in the oxidation of the metal alloy compounds to form soluble ions or ionic complexes. Equation (1) indicates the reaction process for magnesium. Similar equations can be given for zinc and aluminum alloys. The oxidation of the magnesium or other metallic compounds is accompanied by a reduction in the hydronium ions resulting in the evolution of hydrogen, as indicated in equation (2). The oxidation-reduction reactions are exothermic, meaning the reactions proceed spontaneously and liberate energy. The overall generic equation is given by (3).

$$Mg^0 \xrightarrow{acid,water} Mg^{+2} + 2e^- \tag{1}$$

$$2H_2O^+ + 2e^- \xrightarrow{water} 2H_2O + 2H_2\uparrow \tag{2}$$

-continued $$\{\text{Metal}\} + \{\text{Acid}\} \rightarrow \left\{\begin{matrix}\text{soluble metal}\\ \text{ions/ionic complexes}\end{matrix}\right\} + \{\text{hydrogen}\} + \{\text{energy}\} \tag{3}$$

A typical bath consists of 25 wt % (10.5%) phosphoric acid. Catastrophic failure of the cleaning apparatus can occur if the process is not properly controlled. The system illustrated in FIG. 1 fails to provide adequate controls. First, the system is closed. There is no mechanism for the removal of hydrogen produced in the process. Explosive conditions can occur when hydrogen is allowed to accumulate in a confined space. Further, pressure can build up in a closed system. Second, there is no means of managing the heat of reaction associated with the dissolution of the metal in acid. Management of the heat of reaction will provide control of the rate of reaction and prevent "run-away" reactions from occurring. Also, removal of the heat of reaction will prevent other reactions that can occur at higher temperatures from taking place. Third, the cleaning apparatus does not ensure controlled failure as no pressure relief valves are used to manage pressure build up in the leach vessel.

It is evident that the prior art cleaning apparatus does not effectively manage the chemical reactions associated with the dissolution of metal alloys in acidic media. In order to ensure safe operation, the cleaning apparatus should be designed as a chemical reactor, giving consideration to the chemical kinetics and thermodynamics of the processes involved.

SUMMARY OF THE INVENTION

The primary objective of the invention is to provide a method and apparatus for safely and efficiently removing metallic alloy contaminants from a metallic substrate.

Another object of the invention is to provide a method and apparatus for safely and efficiently removing magnesium based alloy from a metallic substrate such as stainless steel or tool steel or super alloys.

The invention provides a method and apparatus for removing contaminants from the surface of a metallic article where the article is placed in a continuously flowing aqueous bath to which is controllably added acid for dissolving the contaminants and cleaning the surface of the article. A purging gas flows over the surface of the bath so that the build-up of hazardous conditions within the bath can be avoided.

REFERENCE NUMERALS USED IN THE DRAWINGS

1—leach vessel (prior art)
2—aqueous phosphoric acid bath
3—acid holding tank
4—end caps
5—polypropylene tubes

10—leach vessel (new)
11—acid bath (new)
12—purge gas outlet
13—acid inlet end
14—purge gas inlet
15—heat exchanger
16—acid inlet stream
17—holding tank
18—mixing unit
19—valve
20—acid outlet
21—waste drum
22—water line

DETAILED DESCRIPTION OF THE PREFERRED EMBODIMENTS

Figure 1:
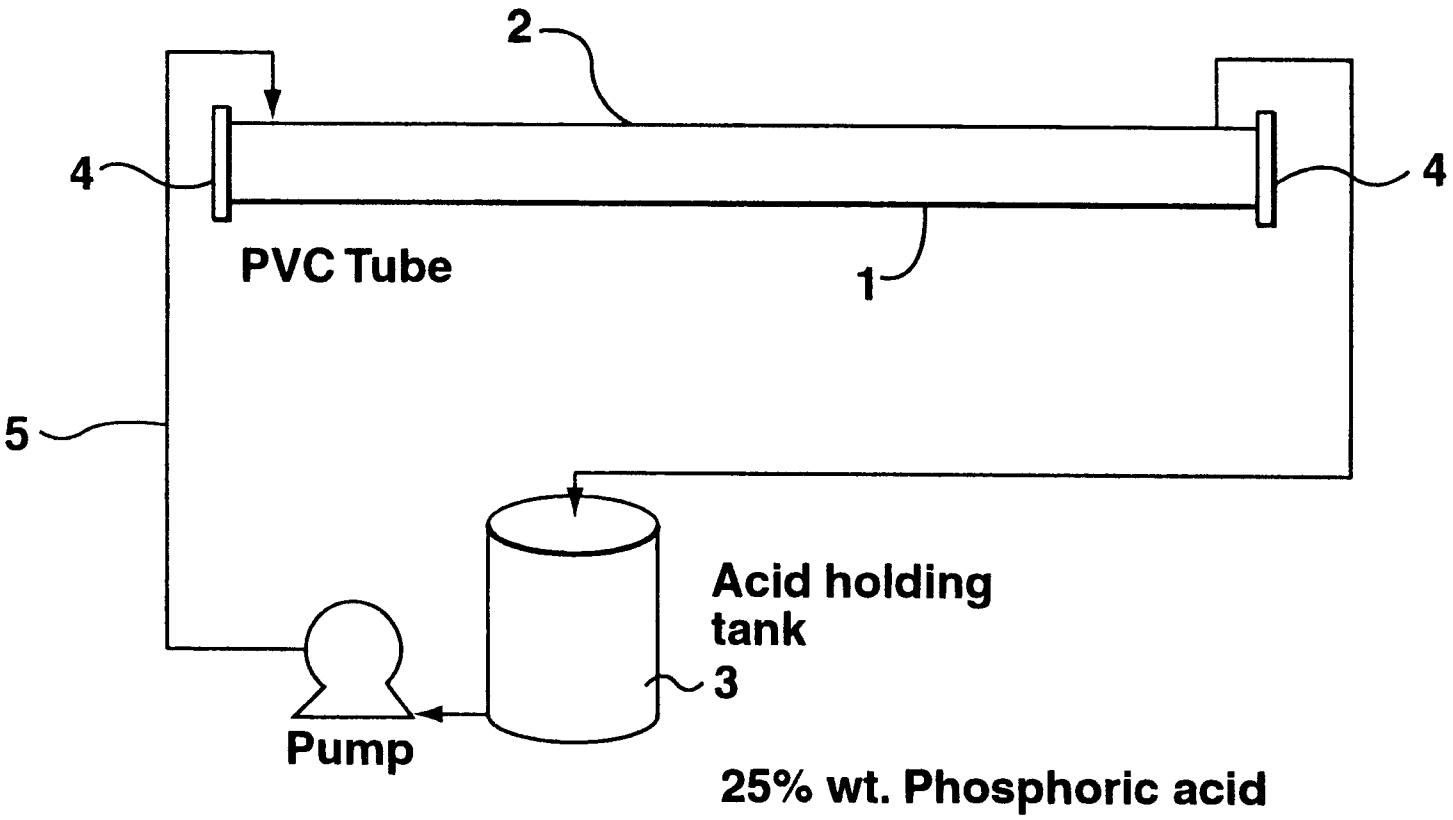
FIG. 1 (Prior art)
FIG. 1 is a schematic representation of the prior art metallic article cleaning process.
Figure 2:
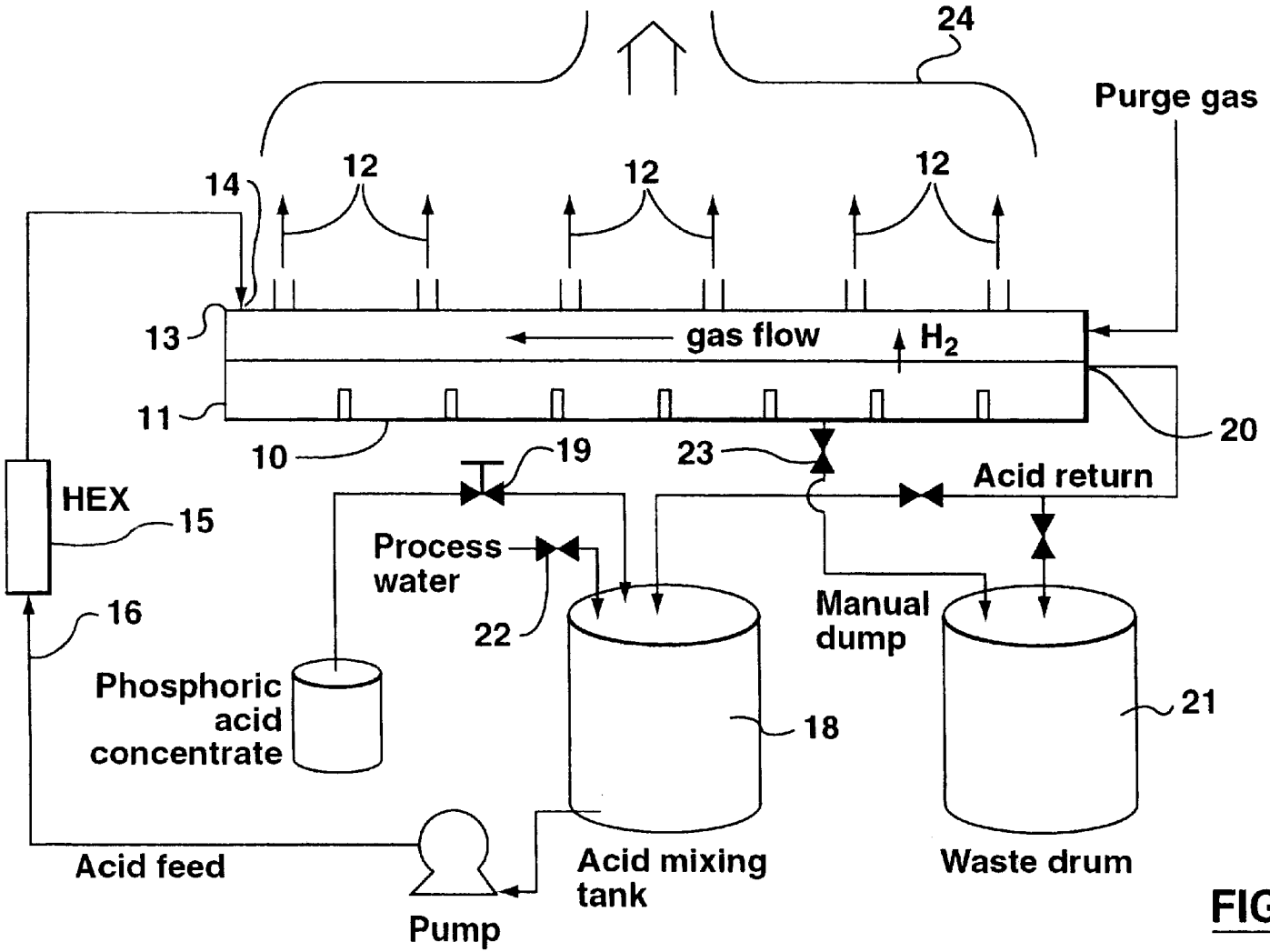
FIG. 2 is a schematic illustration of the preferred embodiment of the present invention.

Referring to FIG. 2, a schematic representation of a novel process and apparatus for cleaning metallic alloy from a metallic part such as an extruder screw for an injection molding machine with phosphoric acid is illustrated. The leach vessel 10 is a hybrid of a plug flow reactor and a two-phase counter-current stripper. The vessel 10 serves to facilitate chemical reaction and separation of reaction products in a single operation. Phosphoric acid flows over the metallic part at a certain flow rate in order to promote liquid phase mass transfer. The reaction of the acid with the magnesium based alloy is diffusion limited. A purge gas flows over the acid bath in a counter-current manner in order to promote mass transfer of hydrogen from the acid bath into the gas phase. The gas phase flow rate must ensure that the concentration of hydrogen in the leach vessel 10 remains at an acceptably low level.

The hydrogen can be vented in either of two ways. The first way for gas venting involves multiple gas exit ports 12 along the top of the leach vessel 10 as shown in FIG. 2. The multiple ports 12 allow the hydrogen to vent naturally by free convection from the leach vessel based on the low density of hydrogen relative to air. The leach vessel 10 is open to the atmosphere at the purge gas outlets 12, which obviates the possibility of the vessel becoming pressurized. Consequently, during normal operation, hydrogen is removed by a combination of free and forced convection. Although the multiple vents 12 exploit the low density of hydrogen relative to air, this concept may require higher purge gas flow rates to ensure that the concentration of hydrogen remains at an acceptably low level, particularly at the end 13 of the leach vessel 10 near the purge gas inlet 14. The rate of diffusion of hydrogen from the leach vessel by free convection is expected to be small compared to the rate of removal by forced convection. It is necessary to ensure that the purge gas maintains a minimum flow rate at all points in the leach vessel during normal operation.

The second way involves a single exit port for the gas at the acid inlet end 13 of the vessel 10. This promotes mass transfer by increasing the turbulence intensity of the gas phase and increasing the amount of gas, which intimately contacts the liquid phase. This promotes the removal of hydrogen by forced convection. Another advantage of this concept is that the acid bath 11 is completely contained, offering greater safety and ease of material handling. This configuration also offers the option of containing the product gas outlet in the event that the stream is required to be treated with a chemical scrubber, by controlled burn of the hydrogen or to simply provide ducting to exhaust the gas out of the building.

A heat exchanger 15 in the acid inlet stream 16 manages the heat of reaction and controls the inlet temperature of the acid to the vessel 10. The acid is pumped through the heat exchanger 15 to an inlet 14 at the top of the leach vessel 10. In the event of a power failure, the acid within the leach vessel 10 is automatically drawn off through valve 23 into waste drum 21.

Figure 3:
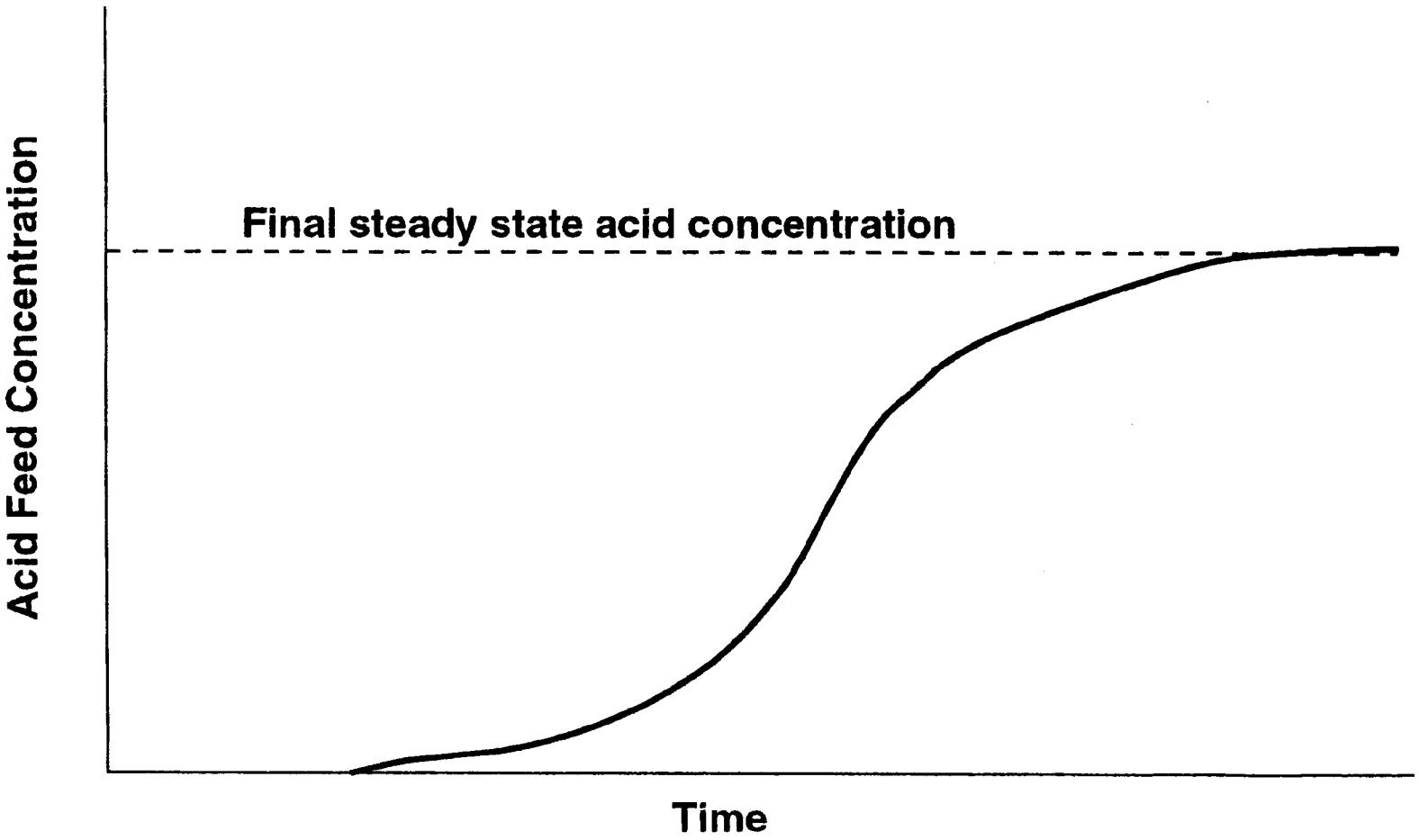
FIG. 3 is a graph of the relationship of acid concentration over time in accordance with the present invention.

The initial period of start-up as acid is being first introduced to the leach vessel poses the greatest risk of failure. At start-up, the acid initially introduced is fresh and at maximum concentration and the greatest amount of metal alloy, with a high surface area, is available to react. Oxygen is present in a confined space and is available to react with hydrogen until the liquid displaces the air in the leach vessel 10. A novel concept for a mixing unit minimizes the risk of initiating an uncontrolled reaction during start-up. Rather than introducing the acid at full strength, the mixing unit 18 introduces water into the leach vessel 10. The valve 19 controls the rate of addition of acid to the water in the acid mixing tank 18. This causes the acid feed concentration to increase gradually to the desired operating concentration as illustrated in FIG. 3. The acid outlet 20 from the leach vessel 10 has the option of directing the acid back to the acid mixing tank 18 or diverting the flow to the waste drum 21 at the end of operation. A water line 22 is fed to the acid mixing tank 18 to provide water for mixing with the acid or rinse water as required.

The minimum ignition energy of hydrogen in air is typically an order of magnitude lower than most combustible gaseous fuels and the minimum ignition energy of hydrogen is less than the expected heat of reaction of the dissolution of processed metal alloy in acid. Further, the ignition energy required to initiate combustion is inversely proportional to the square of the pressure in the vessel 10 and may also may be influenced by the vessel geometry. As a result, an increase in pressure in the vessel 10 as a result of the production of hydrogen will further reduce the energy required to initiate combustion.

It is clear that if explosive conditions are created in the vessel 10, the reaction will proceed spontaneously. Consequently, prevention of the ignition of hydrogen must be achieved by controlling the hydrogen concentration in the vessel 10. The combustion of hydrogen with oxygen can only occur within a certain range of fuel-air concentration. This range is called the explosive range and is defined by a lower and an upper flammability limit. A fuel-air mixture, which falls outside its explosive range, is incapable of igniting or exploding, even if exposed to a spark or flame.

In the case of phosphoric acid, it is safe for up to 25 wt. % acid to be heated to at least 66° C. The operating temperature is determined according to a desired reaction rate. A higher reaction rate will reduce the time required to clean the screw, however it will also result in a greater rate of production of hydrogen and consequently will require greater purge gas flow rates to keep the concentration of hydrogen to an acceptable level. A higher reaction rate will also result in a greater rate of heat generation and will increase the heat duty of the heat exchanger 15 in order to control the temperature.

In the case where phosphoric acid is used to remove magnesium based alloy contaminants, it is recommended that the acid temperature observed at the outlet 20 of the cleaning vessel 10 not exceed 40° C. since the behavior of the acidizing process becomes less predictable above 40° C. The behavior of the magnesium based alloy in the acid is well known for temperatures of 40° C. and lower.

A phosphoric acid solution provides a very satisfactory solution for the screw cleaning process. The acid concentration influences the time required to clean the screw as well as the rate of in situ hydrogen production and heat generation. It is recommended that the phosphoric acid concentration not exceed 15.11% by volume phosphoric acid (i.e. 25 wt-% phosphoric acid), since the behavior of magnesium in phosphoric acid solution becomes uncertain beyond 25 wt % phosphoric acid. The flow rate of the acid should be sufficient to ensure turbulent flow. Turbulence is required to promote mass transfer in the liquid phase in order to ensure operation in the reaction-limited vessel 10 as well as to promote mass transfer between liquid and gas phases.

It has been found that hydrogen is the only chemical species of consequence in the product gas produced from the reaction of the magnesium based alloy with the phosphoric acid bath. The purge gas enhances removal of hydrogen by promoting mass transfer at the liquid-gas interface and dilutes the hydrogen concentration below 10% of the lower explosive limit of hydrogen. The preferred purge gas is air. The minimum purge gas flow rate is dependent on the reaction rate in the vessel and will be dictated by specifying the operating temperature and the acid concentration. It is desirable to maximize the purge gas flow rate in order to promote mass transfer. Particularly, a greater relative velocity between the liquid and gas phases and greater gas phase turbulence will increase mass transfer by convection. In order to promote turbulence, baffles may be installed in the base of the vessel 10. The baffles may be used to support the screw so that it is held above the floor of vessel 10 and thereby increase the interface between the screw and the bath.

Figure 4A:
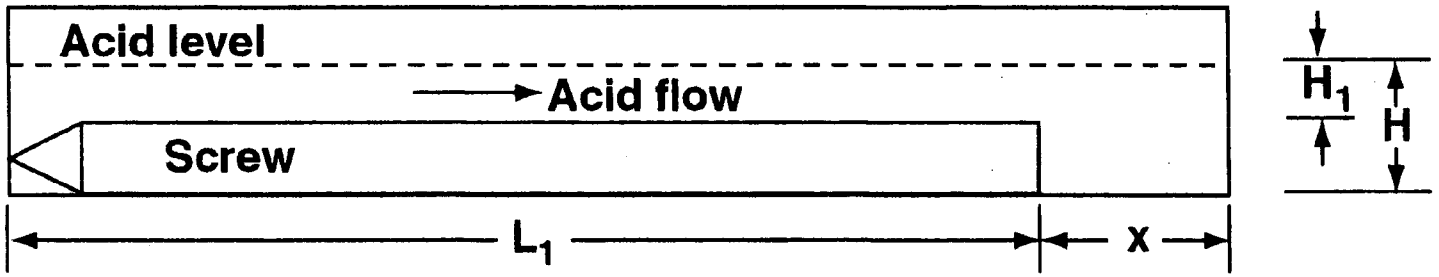
FIGS. 4A, 4B and 4C illustrate, schematically, the preferred relationship between part size, bath depth and purge gas levels in accordance with the present invention.
Figure 4C:
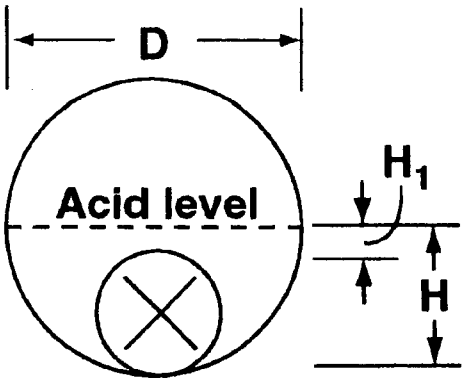
Figure 4B:
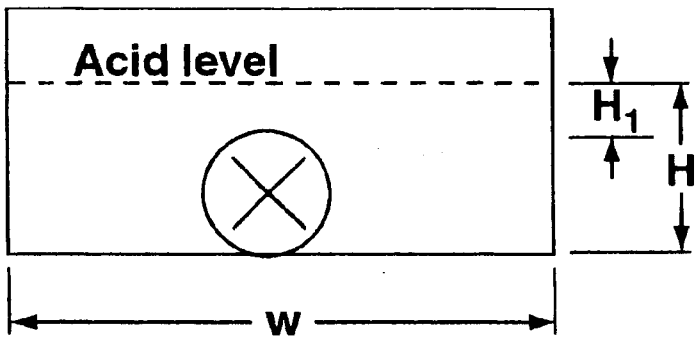

The reactor-stripper can be a tubular or a rectangular vessel as outlined in FIGS. 4A, 4B and 4C. The length of the vessel (L) is sufficient to allow the entire part being cleaned to be submersed in the bath.

Since the reaction is a heterogeneous reaction occurring at the surface of the metal alloy, the reactor behaves like a fixed bed reactor. The total volume of acid in the vessel does not directly influence chemical conversion or reactivity. The flow rate and total volume of acid resident in the vessel will be determined primarily by heat transfer requirements since the acid behaves as a coolant. Ideally, the temperature profile along the screw should remain constant spatially and temporally.

The volume of acid influences the effect of agitation on the reaction rate. This effect of agitation on reaction rate indicates that the reaction is diffusion limited for low Reynolds number flows. Consequently, the total volume of acid and flow characteristics may effect the overall rate of reaction if the process operates in the diffusion-limited regime. The total volume of acid resident in the vessel will not effect the reaction rate provided the Reynolds number of the acid is sufficiently high to operate in the reaction-limited regime.

The acid may be re-usable for multiple screw cleanings. The number of screw cleanings is limited since the acid will eventually become saturated. Additional screw cleanings may take longer since the acid will become less reactive as it becomes more saturated. The head of acid above the screw ($h_1$) should be minimized in order to minimize the distance the hydrogen must diffuse to reach the gas-liquid interface. A certain amount of acid above the top of the screw is necessary, however, to promote mixing and to ensure hot spots do not form at the top of the screw. A starting point could be a head of 20 mm of acid above the screw.

The choice of cylindrical or rectangular cross section is dependent on the desired volume of acid and economic considerations. As stated above, it is desirable to minimize the head of acid above the screw in order to minimize the diffusion path of the hydrogen. It is also desirable to maximize the interfacial surface area between the acid and purge gas. A rectangular geometry is of advantage if a large volume of acid is required to promote heat and mass transfer. A cylindrical geometry may be desirable if the vessel is constructed from a pre-fabricated pipe.

The vessel should contain baffles, which promote liquid phase turbulence. A high, liquid phase Reynolds number is desirable in order to promote heat and mass transfer in the liquid phase. This will prevent hot spots at the reaction sites and ensure that the process operates in the reaction-limited regime, which is well understood, rather than the diffusion-limited regime. It is also desirable to maximize the difference in relative velocities of the purge gas and acid phases in order to promote mass transfer of hydrogen from the bulk liquid to the purge gas. A high liquid phase flow rate also promotes isothermal operation.

The headspace volume in the reactor-stripper should be minimized in order to promote gas phase turbulence and promote intimate contact of the purge gas and the acid. The headspace volume does not influence the purge gas flow rate required to dilute the hydrogen to 10% of the lower explosive limit. Although a larger headspace will result in a longer time for the hydrogen to accumulate to explosive conditions, it will also result in a larger inventory of hydrogen in the vessel when explosive conditions are reached. The headspace of the reactor-stripper should be designed to prevent the accumulation of hydrogen in the event of a power failure by promoting the removal of hydrogen by free convection.

The size of the acid mixing tank and waste tank will be governed by the total volume of acid in the system. Similarly, the pump duty will be governed by the desired acid flow rate. The heat exchanger duty however, depends not only on the volume of acid and acid flow rate, but also the total heat losses in the system. Heat losses from the reactor-stripper, from the acid feed and return lines and from the mixing tank will occur. However, the heat transport system should be able to dissipate the maximum possible power output of the reactor.

Since the stripper-reactor is open to the atmosphere, the primary criteria for material selection are chemical resistance and cost. The stripper-reactor may be constructed from plastic material. Table I outlines plastic materials recommended for handling strong acids. PVC, as well as natural and butyl rubber, polyesters and phenolic resins are satisfactory for use with phosphoric acid. It is recommended that rigid CPVC be used as a material of construction if the vessel is to be constructed from plastic since it is known to exhibit a high degree of chemical resistance to phosphoric acid. The materials outlined in Table IX are also acceptable.

The stripper-reactor may also be constructed from chemically resistant metal alloys. An advantage of the use of metal includes the ability to dissipate heat, improved mechanical strength and extended life of the equipment. The 300 series stainless steels for example, exhibit good to excellent chemical resistance to phosphoric acid.

TABLE I

| Plastic | Maximum Temperature [° C.] | Ultimate Strength [Mpa] | Tensile |
|---|---|---|---|
| FEP | 208 | 17–27 | |
| PTFE | 290 | 7–28 | |
| CTFE | 180–200 | 32–39 | |
| ETFE AND ECTFE | 150 | 45–48 | |
| PBT | 140 | 55–57 | |
| PTMT | 130 | 57 | |
| Polyaryl ether | 120 | 52 | |
| Polyaryl sulfone | 260 | 90 | |
| Phenylene oxide based | 230–280 | 54–66 | |

TABLE I-continued

| Plastic | Maximum Temperature [° C.] | Ultimate Strength [Mpa] | Tensile |
|---|---|---|---|
| materials | | | |
| Polyimide | 260 | 34–52 | |
| Polysulfone | 150 | 70 | |
| Rigid CPVC | 110 | 52–62 | |
| PVC-ABS* | N/A | 18–41 | |
| PVC-acrylic* | N/A | 38–45 | |

Plastic materials exhibiting chemical resistance to strong acids
*PVC-ABS is resistant to weak acids and generally resistant to strong acids with the possibility of slight effects PVC-acrylic is resistant to weak acids. Slight effects are possible for use with strong acids.

A novel process and apparatus for the removal of metallic alloys and, in particular, magnesium based alloys, from injection molding screws has been disclosed. This process facilitates the safe removal of hydrogen produced in situ from the system and provides a means of managing the heat of reaction. A two-phase counter-current reactor-stripper facilitates both chemical reaction and separation. A purge gas flows counter-current to the acid stream promoting mass transfer of the hydrogen from the liquid and diluting it to an acceptable concentration. If plastic material is to be used for the reactor-stripper, rigid CPVC is preferred as the material of construction due to its high chemical resistance to strong acids. If it is to be constructed of metal, a 300 series stainless steel is preferred.

While the invention has been described in relation to phosphoric acid for the removal of magnesium based alloys from an extruder screw of an injection molding machine, the invention is not so limited. The invention may be used to strip other alloys such as aluminum based and zinc based alloys. The part may be any part that is contaminated with these alloys and relatively impervious to acids such as phosphoric, hydrochloric or sulfuric acid. Other inorganic acids, which have suitable etching rates, could also be used.

It is to be understood that the invention is not limited to the illustrations described and shown herein, which are deemed to be merely illustrative of the best modes of carrying out the invention, and which are susceptible of modification. The invention rather is intended to encompass all such modifications that are within its spirit and scope as defined by the claims.

What is claimed is:

1. A method for removing contaminants from the surface of a metallic article comprising the following steps:

placing said article in an aqueous bath, said bath having a continuous flow of aqueous fluid through said bath;

flowing a purging gas over the surface of said aqueous fluid while in said bath;

controllably adding an acid to said aqueous fluid, said acid being capable of dissolving said contaminants and substantially cleaning said article; and controlling the temperature in said bath;

whereby the rate at which contaminant is removed from said article is tightly controlled so that hazardous operating conditions may be avoided.

2. In a method for removing contaminants as defined in claim 1 wherein said acid is an inorganic acid.

3. In a method for removing contaminants as defined in claim 2 wherein said acid is one of phosphoric, hydrochloric or sulfuric acid.

4. In a method as defined in claim 3 wherein said acid is phosphoric acid and said bath is maintained at a temperature that does not exceed 66 degrees C.

5. In a method as defined in claim 4 wherein said bath is maintained at a temperature that does not exceed 40 degrees C.

6. In a method as defined in claim 1, claim 2, claim 3, claim 4 or claim 5 wherein said contaminant is a metal alloy.

7. In a method as defined in claim 6 wherein said alloy is a magnesium based alloy.

8. In a method as defined in claim 7 wherein said magnesium based alloy is AZ91D.

9. In a method as defined in claim 1, claim 2, claim 3, claim 4 or claim 5 wherein said contaminant is one of a magnesium, aluminum or zinc based alloy.

10. In a method as defined in any one of claims 1, 2, 3, 4, or 5, wherein said article is an extruder screw for use in a metal alloy injection-molding machine.

11. In a method as defined in any one of claims 1, 2, 3, 4, or 5, wherein said article is a stainless steel article.

12. An apparatus for cleaning contaminants from the surface of a metallic article, said apparatus comprising:

an acid bath;

a reactor-stripper for containing said bath;

means for controlling the rate of acid flow through said bath;

means for controlling the acid concentration in said bath;

means for controlling the temperature of said bath;

a source of purging gas; and means for controllably flowing said purging gas over a surface of said bath;

whereby the temperature and acidity of said bath may be tightly controlled so as to control the rate of removal of contaminants from said article and remove any airborne contaminants safely so that any potentially hazardous condition arising from the cleaning process can be avoided.

13. Apparatus for cleaning contaminants as defined in claim 12 wherein said means for controlling the acid concentration in said bath comprises a source of acid, a source of water, a mixing tank and valve means for controlling the rate of flow of water and acid into said mixing tank.

14. Apparatus for cleaning contaminants as defined in claim 12 or claim 13 further including means for venting said purging gas to the atmosphere.

15. The apparatus for cleaning contaminants as defined in claim 12 or claim 13, wherein said contaminants are metal alloys.

16. The apparatus for cleaning contaminants as defined in claim 12 or claim 13, wherein said contaminants are one of a magnesium, aluminum or zinc based alloy.

17. The apparatus for cleaning contaminants as defined in claim 12 or claim 13, wherein said article is a stainless steel article.

18. The apparatus for cleaning contaminants as defined in claim 12 or claim 13, wherein said article is an extruder screw for a metal alloy infection-molding machine.

19. The apparatus for cleaning contaminants as defined in claim 12 or claim 13, wherein said acid is an inorganic acid.

20. The apparatus for cleaning contaminants as defined in claim 12 or claim 13, wherein said acid is one of phosphoric, hydrochloric or sulfuric acid.

21. The apparatus for cleaning contaminants as defined in claim 12 or claim 13, wherein said purging gas is air.

* * * * *